US006346009B1

(12) United States Patent
Lin

(10) Patent No.: US 6,346,009 B1
(45) Date of Patent: Feb. 12, 2002

(54) SHIELDED MULTIPLE ELECTRICAL CONNECTOR ASSEMBLY

(75) Inventor: Cheng Te Lin, Taipei Hsien (TW)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/439,142

(22) Filed: Nov. 12, 1999

(30) Foreign Application Priority Data

Nov. 11, 1998 (TW) ..... 87218698 U

(51) Int. Cl.[7] ..... H01R 13/648
(52) U.S. Cl. ..... 439/607; 439/701
(58) Field of Search ..... 439/607, 701, 439/717, 608, 609, 610

(56) References Cited

U.S. PATENT DOCUMENTS

| | | | | |
|---|---|---|---|---|
| 4,873,395 A | | 10/1989 | Mast | 174/35 |
| 5,004,867 A | | 4/1991 | Mast | 174/35 |
| 5,037,330 A | | 8/1991 | Fulponi et al. | 439/607 |
| 5,125,854 A | | 6/1992 | Bassler et al. | 439/701 |
| 5,221,212 A | | 6/1993 | Davis | 439/108 |
| 5,254,010 A | | 10/1993 | Davis | 439/108 |
| 5,401,192 A | | 3/1995 | Briones et al. | 439/639 |
| 5,405,267 A | | 4/1995 | Koegel et al. | 439/79 |
| 5,419,721 A | | 5/1995 | Lignelet | 439/701 |
| 5,437,564 A | | 8/1995 | Lignelet | 439/701 |
| 5,676,569 A | | 10/1997 | Davis | 439/731 |
| 5,695,362 A | | 12/1997 | Hillbish et al. | 439/541.5 |
| 5,735,699 A | | 4/1998 | Tan et al. | 439/92 |
| 5,738,539 A | * | 4/1998 | Caveney et al. | 439/535 |
| 5,851,125 A | | 12/1998 | Hsu et al. | 439/541.5 |
| 5,961,350 A | | 10/1999 | Shiu | 439/607 |
| 6,077,127 A | * | 1/2000 | Wu | 439/717 |

FOREIGN PATENT DOCUMENTS

| | | | |
|---|---|---|---|
| JP | 48-44791 | 6/1973 | |
| JP | 8-45590 | 2/1996 | H01R/13/10 |

* cited by examiner

*Primary Examiner*—Gary Paumen
*Assistant Examiner*—Alexander Gilman
(74) *Attorney, Agent, or Firm*—Robert J. Zeitler

(57) ABSTRACT

A compact electrical connector assembly is provided having a conductive bracket and at least two connectors. The bracket is preferably unitary, and may be stamped from a metal sheet. The bracket has a plurality of walls forming an interior cavity to receive the connectors. The connectors are adjacently arranged within the bracket in a side-by-side manner. The bracket includes a plurality of projecting elements, such as tabs or flanges, which clamp against the connectors to hold the assembly together in an integral manner.

20 Claims, 7 Drawing Sheets

SHIELDED MULTIPLE ELECTRICAL CONNECTOR ASSEMBLY

BACKGROUND OF THE INVENTION

The present invention generally relates to electrical connectors and more particularly to a multiple electrical connector assembly.

Certain hardware requires multiple electrical connectors to be mounted in the same vicinity, such as at the rear of a computer box. For example, multiple USB connectors are sometimes provided on a computer to provide respective input/output connections to multiple peripheral devices. In a conventional assembly of multiple electrical connectors, however, the connectors are assembled in an end-to-end longitudinal fashion. Such a connector assembly typically includes a two-piece bracket which secures the connectors. Unfortunately, the overall width of such a conventional connector assembly can be excessive due to the transverse arrangement of the connectors. This can undesirably limit efforts to design reduced-sized components in which the assembly is installed. Furthermore, the manufacture and assembly of known two-piece brackets are unduly complicated and expensive.

Therefore, a need exists for an improved electrical connector assembly.

SUMMARY OF THE INVENTION

The present invention provides an improved shielded electrical connector assembly including a bracket for securing together multiple connectors in an integral, compact fashion. For example, in an embodiment, an electrical connector assembly is provided which includes a plurality of electrical connectors, each having an insulative housing containing a plurality of electrical terminals. Each of the terminals has a contact portion for mating to a respective terminal of a complementary mating plug connector and a tail portion for mating to a respective conductor. Each connector further includes a conductive shield substantially enclosing, or at least partially enclosing, the housing. The shield has a mating portion proximate to the contact portions of the terminals. The mating portion extends forwardly of each of the electrical connectors. The assembly additionally includes a conductive bracket for securing together the electrical connectors in an integral fashion. The bracket, in an embodiment, includes a lateral wall with opposed side walls depending from the lateral wall. The conductive bracket embraces the electrical connectors between the opposed side walls. The mating portions of the shields of the electrical connectors extend forwardly of front edges of the opposed side walls.

The bracket includes a plurality of flanges or tabs which clamp against the connectors to secure the bracket around the connectors. In an embodiment, at least some of the tabs or flanges are plastically bendable in an inward direction against the connectors to retain the connectors within an interior cavity generally defined by walls of the bracket. For example, in an embodiment, the bracket includes a pair of flanges extending inwardly from the front edges of the opposed side walls. Each of the inward flanges clamps a respective edge of one of the electrical connectors adjacent the respective front mating portion.

Also, the shield of each of the electrical connectors has a front face outside of the mating portion of the shield and the inward flanges engage the front face of the respective electrical connector. In an exemplary embodiment, the bracket includes a finger which extends downwardly from a front edge of the lateral wall, wherein the finger clamps against front faces of the adjacent electrical connectors. Also, in an embodiment, the bracket includes one or more rear flanges or rear wall members for securely clamping the rear of the bracket to the electrical connectors. Additionally, an embodiment of the one or more tabs extends from a bottom lateral edge of the bracket for securely clamping an underside surface of the connectors.

The rear of the bracket includes one or more tabs or wall portions for retaining a rear side of the connectors. For example, an embodiment of the bracket includes a pair of rear walls extending inwardly from rear edges of respective side walls. The rear walls may substantially cover a rear of the connectors, providing enhanced shielding at the rear of the connectors.

In an embodiment, the shield of at least one of the electrical connectors includes one or more feet for engaging a circuit board on which the assembly is mounted. The feet may be in the form of insertion type mounting legs for extending through apertures on a circuit board. The feet may also have a surface mount type of mounting structure.

An advantage of the present invention is to provide a multiple electrical connector assembly comprising at least two vertically upstanding connectors secured together in an integral side-by-side manner.

Another advantage of the present invention is to facilitate easy manufacture and assembly.

A further advantage of the present invention is to provide an electrical connector with reduced overall size.

Yet another advantage of the present invention is to provide an electrical connector that resists loosening from an installed position.

Additional features and advantages of the present invention are described in, and will be apparent from, the following detailed description when read in conjunction with the appended drawings.

DETAILED DESCRIPTION OF PREFERRED EMBODIMENT

Figure 1:
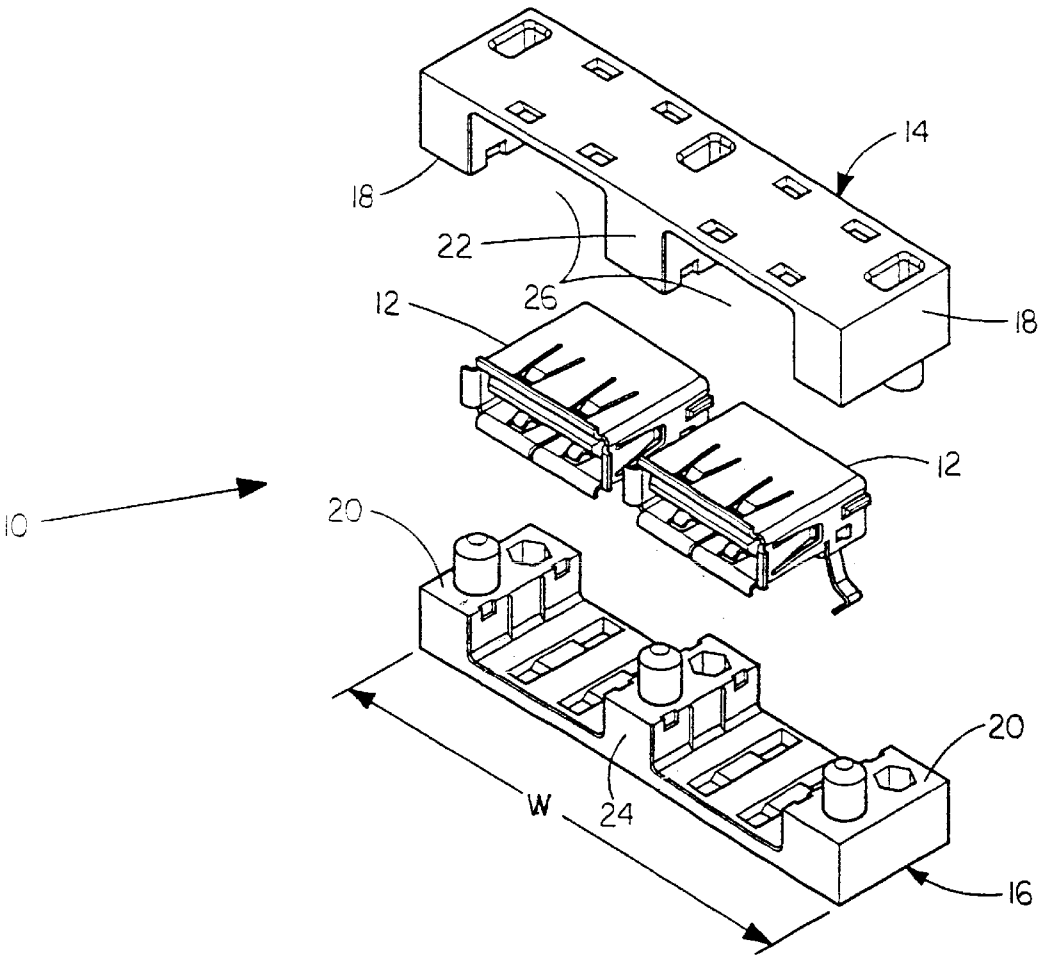
FIG. 1 PRIOR ART
FIG. 1 is an exploded view of a conventional multiple electrical connector assembly.

Now referring to the drawings, wherein like numerals designate like components, FIG. 1 illustrates a conventional electrical connector assembly 10 with two connectors 12 secured in transverse end-to-end arrangement by upper and lower mounting shell members 14 and 16, respectively. The upper mounting shell member 14 and lower mounting shell member 16 fit together to securably enclose two transversely arranged connectors 12. The illustrated connectors are standard USB A-type connectors. The upper mounting shell member 14 include a pair of end walls 18 located at opposite ends. The end walls 18 of the upper mounting shell member respectively engage with a pair of end walls 20 of the lower mounting shell member 16. Additionally, the upper mounting shell member 14 has an intermediate wall 22 located centrally between the end walls 18. The lower mounting shell member 16 has an intermediate wall 24 located to engage with the intermediate wall 22 of the upper mounting shell member 14. The upper and lower mounting shell members 14, 16 fit together to define two recessed spaces 26 to accommodate the two connectors 12. However, an overall width dimension W of the conventional electrical connector assembly 10 is unnecessarily great due to the transverse end-to-end arrangement of the connectors 12. Additionally, the intermediate walls 22, 24 disposed between the connectors 12 substantially contribute to the width dimension W. Accordingly, size reduction of an electronic component (not shown) using the conventional electrical connector assembly 10 is limited. Moreover, the separate upper and lower mounting shell members 14, 16 of the conventional electrical connector assembly 10 is expensive to manufacture and assemble.

Figure 2:
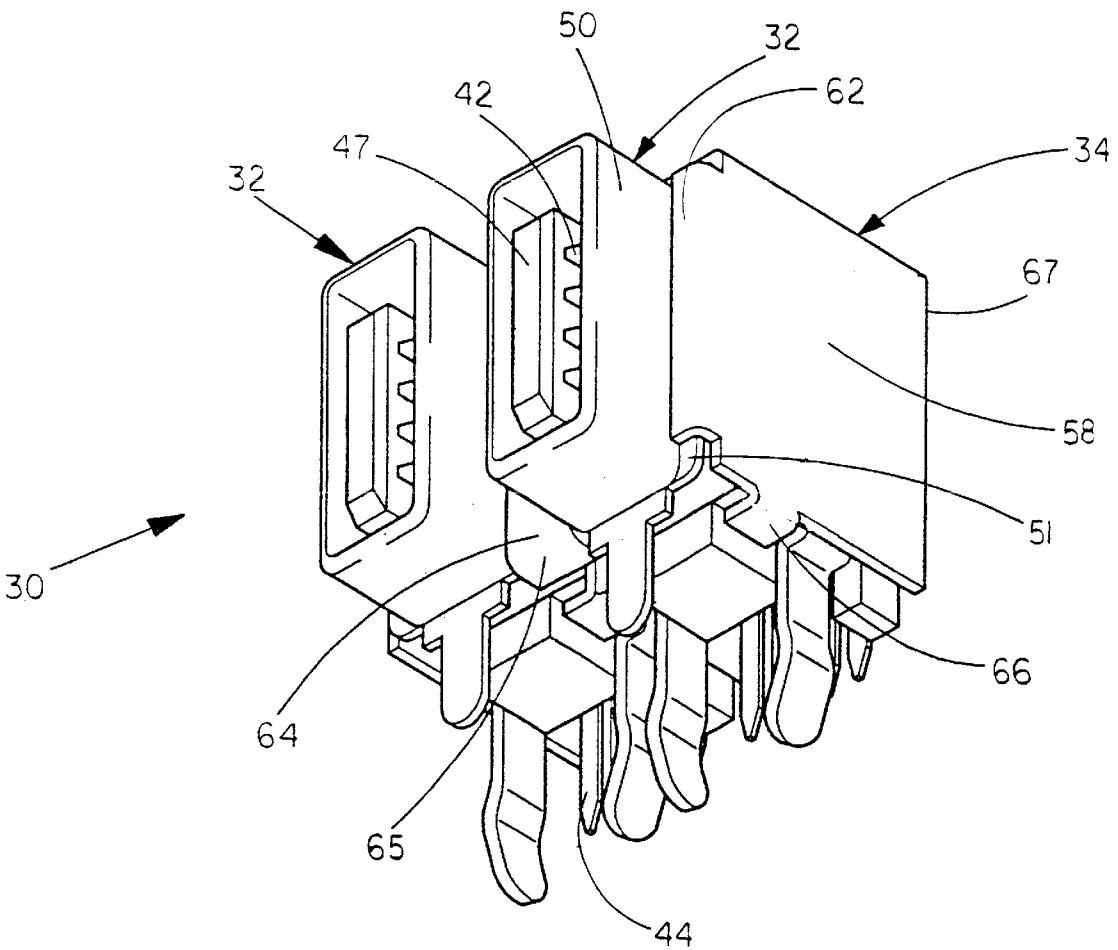
FIG. 2 is a perspective view of a multiple electrical connector assembly according to an embodiment of the present invention.
Figure 4:
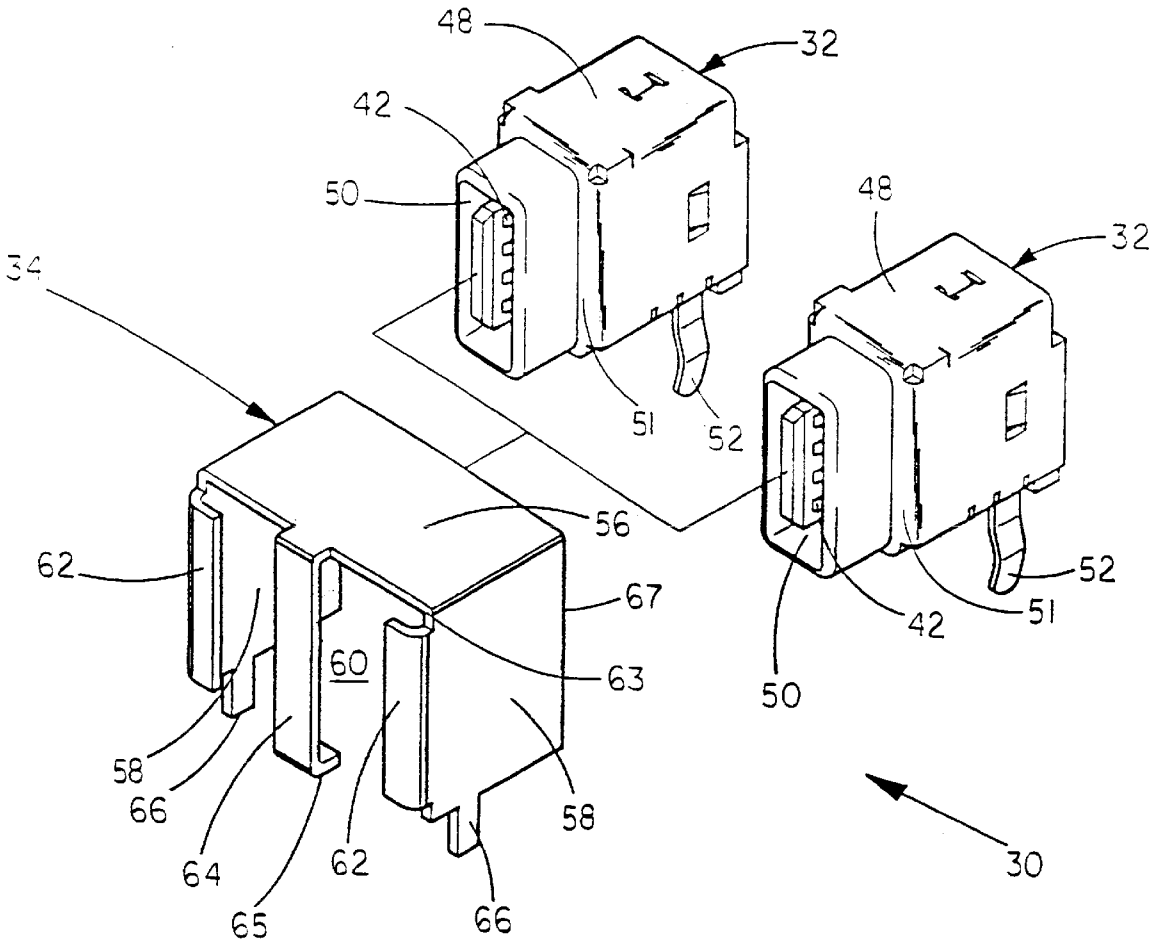
FIG. 4 is an exploded perspective view of the multiple electrical connector assembly of the present invention, showing a bracket and the multiple connectors.
Figure 5:
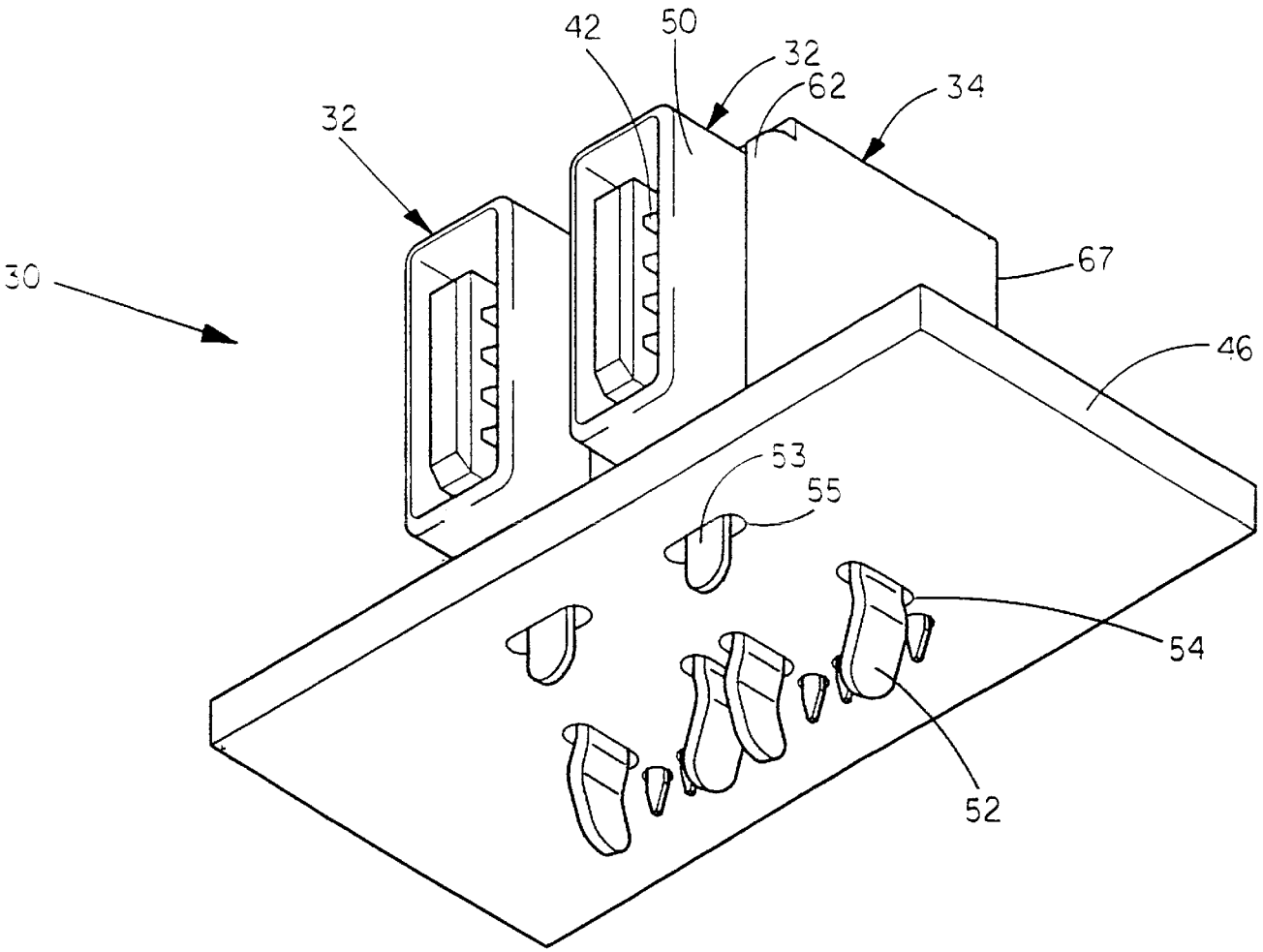
FIG. 5 is a perspective view of the electrical connector assembly as installed on a circuit board.

Turning to FIGS. 2, 4 and 5, an electrical connector assembly 30 is illustrated as constructed in accordance with teachings of the present invention. The connector assembly 30 includes at least two vertically upstanding connectors 32 secured within a bracket 34. In an embodiment, the bracket 34 is unitarily formed of a conductive material, providing enhanced shielding.

The connectors 32 may be, in an embodiment, USB A-type connectors having a vertically upstanding configuration, although the invention could be used with other types of connectors as well. In a manner which is generally known, as illustrated FIG. 3, the connectors 32 have an insulative housing 36 and a plurality of conductive terminals 38. A plurality of terminal support cavities 40 are formed in the housing to securely hold the respective terminals 38. Each of the terminals has a contact portion 42 for mating to a respective terminal of a complementary mating plug connector (not shown) and a tail portion 44 for mating to a respective conductor on a circuit board 46 (FIG. 5). The contact portions 42 are disposed in a vertical column at a terminal support portion 47 of the housing 36.

Figure 3:
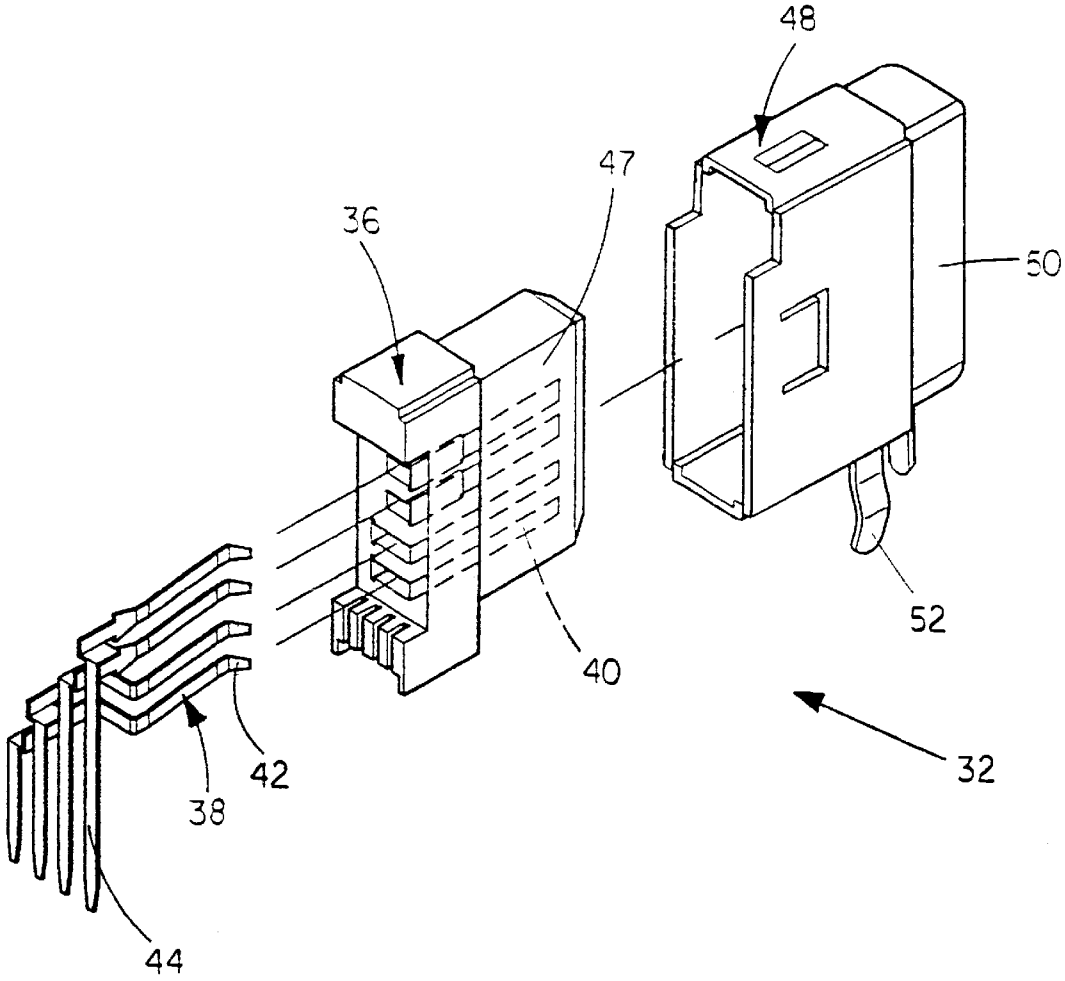
FIG. 3 is an exploded perspective view of a single electrical connector from the assembly of FIG. 1.

Still referring to FIG. 3, each of the connectors 32 further includes a conductive shield 48 which at least partially encloses the housing 36. The shield 48 has a mating portion 50 which is proximate to the contact portions 42 of the terminals, defining an opening to receive the inserted mated plug. The mating portion 50 projects forwardly of a front face 51 (FIGS. 2 and 4) of the shield on each of the electrical connectors 32. Also, each of the connectors 32 includes one or more feet 52 for mounting the connector 32 to the circuit board 46 (FIG. 5). In the illustrated embodiment, each of the connectors 32 includes a pair of rear feet 52 and a front foot 53 extending downwardly from the shield 48 formed as mounting legs for extending through apertures 54, 55, respectively, in the circuit board 46. In another embodiment, the feet 52, 53 may be formed with a surface mount structure, as is generally known in the art, for fixedly securing to a surface of the circuit board with solder or screws.

According to an aspect of the invention, for mounting the connectors 32 in a compact and sturdy manner, the bracket 34 secures together the electrical connectors in an integral fashion comprising the assembly 30, as shown in FIGS. 2, 4 and 5. The illustrated assembly 30 includes multiple connectors 32 held adjacently side-by-side by the bracket 34 in a vertical mounting orientation. As shown in FIG. 4, the bracket 34, in an embodiment, includes an upper lateral wall 56 with opposed side walls 58 depending from the upper lateral wall 56. The side walls 58 extend downwardly from respective sides of the upper lateral wall 56 generally perpendicularly thereto. An interior cavity 60 (FIG. 4) is generally defined between the side walls 58. The bracket 34 closely receives the electrical connectors 32 between the opposed side walls 58 within the cavity 60, embracing the connectors 32 together in a side-by-side fashion, as illustrated in FIG. 2. The connectors 32 are held adjacently to each other to minimize space.

So that each of the connectors 32 can both receive a respective mated plug connector and mount in an aperture in a computer box (not shown) without hindrance by the bracket 34, the mating portion 50 of each of the shields 48 projects forwardly of front edges 63 of the opposed side walls 58 and upper lateral wall 56 of the bracket 34. This is illustrated in FIGS. 2 and 5, showing the connectors 32 assembled with the connector 34.

The bracket 34 includes a plurality of projecting elements which clamp against the connectors 32 to hold the assembly together in an integral manner. For example, in the embodiment illustrated in FIGS. 2, 4 and 5, the bracket includes a pair of flanges 62 which extend inwardly from front edges of the opposed side walls 58. Each of the flanges 62 clamps against a respective one of the electrical connectors 32. Specifically, each of the flanges 62 is engaged against the shield of the respective electrical connector 32 at the front face 51 (FIGS. 2 and 4) of the shield 48 alongside the mating portion 50 of the shield 48. In an embodiment, a pair of flanges (not shown) may also extend inwardly from rear edges 67 of the opposed side walls 58. Front and rear flanges on the same side wall 58 can cooperate to clamp a connector therebetween. Additionally, in the illustrated assembly 30, a finger 64 extends downwardly from a front edge of the upper lateral wall 56 between the mounting portions 50 of the adjacent connectors 32. The finger 64 engagably clamps against the front faces of the electrical connectors 32. In the embodiment of FIGS. 2, 4 and 5, the finger 64 extends downwardly generally the height of the connectors 32 so that a bottom 65 of the finger 64 can be bent inwardly to clamp the bottom of the connectors 32.

Furthermore, the bracket 34 further includes a pair of tabs 66, each tab 66 projecting downwardly from a bottom edge of a respective one of the side walls 58. As shown in FIG. 2, the tabs 66 are bent inwardly to engage against a bottom surface of a respective connector 32. In an embodiment, the bracket 34 may also include at least one rear flange or tab wall (not shown) extending from a rear edge of lateral wall 56 for clamping against a rear of the connectors 32.

The flanges 62, finger 64 and tabs 66 are bendable, thereby advantageously facilitating easy manufacture and assembly of the bracket around the connectors. Furthermore, the bracket 34 is relatively inexpensive to manufacture, as it can be easily stamped in unitary form from a sheet in a desired shape and then shaped by bending. The bracket 34 eliminates the step required in connection with the conventional assembly of FIG. 1, whereby the upper and lower mounting shell members 14, 16 must be separately manufactured and then secured together.

In assembled condition, as illustrated in FIG. 5, the integral assembly 30 is compact in size and sturdy in configuration. The assembly is mountable to the circuit board 46 by inserting the feet 52, 53 through corresponding apertures 54, 55 and by contacting the tail ends 44 of the terminals 38 to contact portions of the circuit board 46. The assembly 30 is advantageously low-profile in shape and has a small width dimension, thereby occupying little space. Accordingly, a device in which the connector assembly 30 is to be used may be designed to have an optimally compact size as well.

Figure 6:
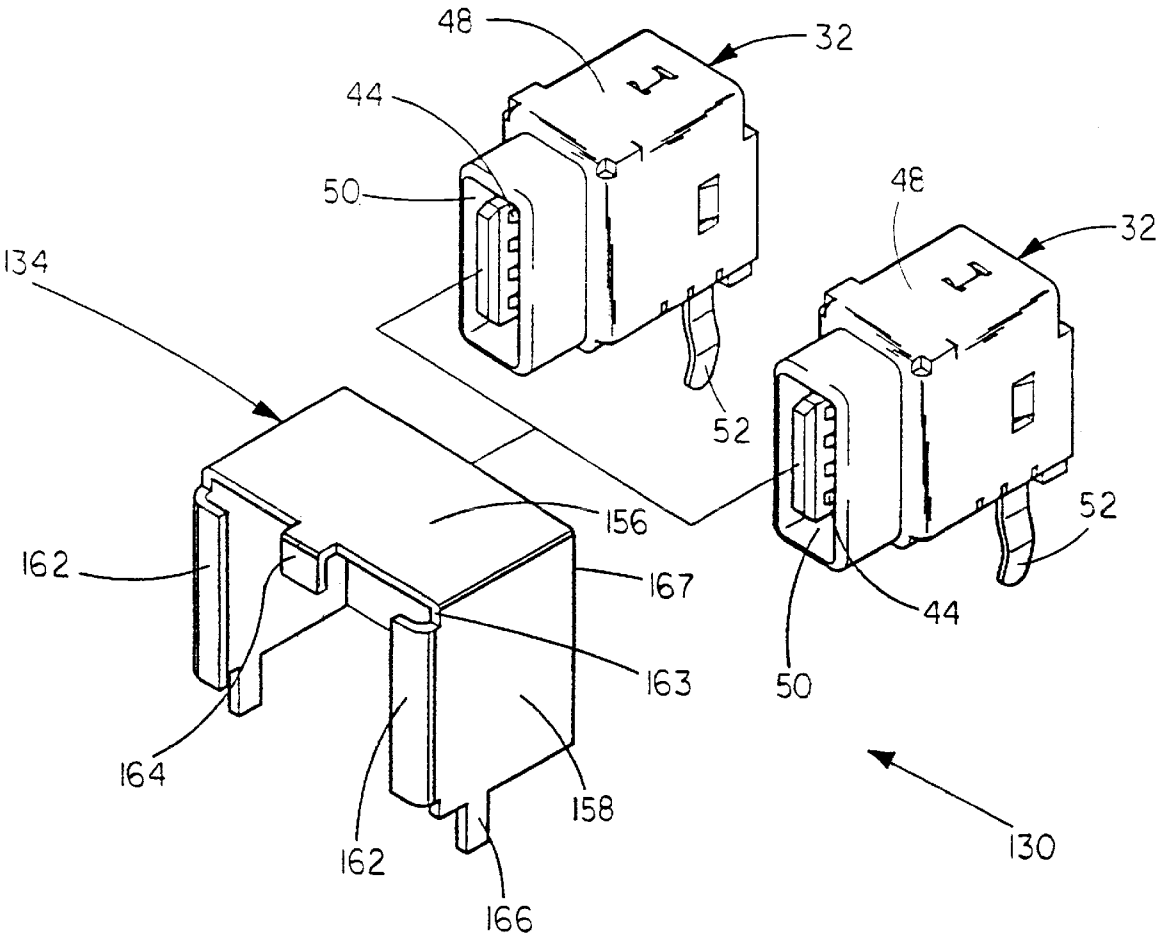
FIG. 6 is an exploded perspective view of electrical connector assembly according to another embodiment of the invention.
Figure 7:
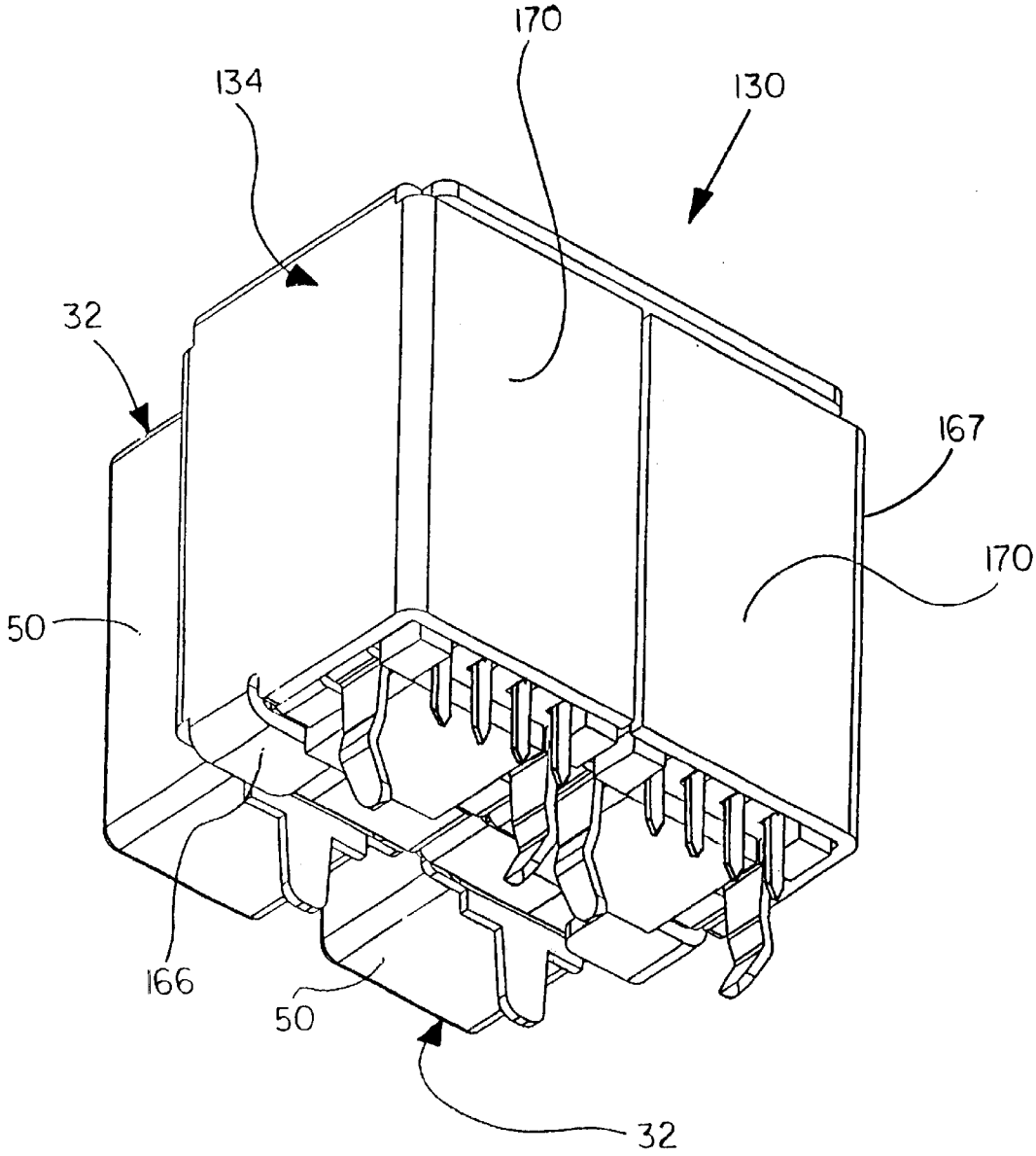
FIG. 7 is a lower, rear perspective view of the connector assembly of FIG. 6 in an assembled condition.

Referring to FIGS. 6 and 7, another connector assembly 130 is illustrated having features according to the present invention. The assembly 130 includes a bracket 134 for securing together multiple connectors, such as the pair of connectors 32. The bracket 134 has an upper lateral wall 156 and opposed side walls 158 and front edges 163, similar to the lateral wall 56, side walls 58 and front edges 63 of the bracket 34 described in connection with FIGS. 2, 4 and 5. A pair of tabs 166 project downwardly from the respective side walls 158. The tabs 166 may be bent inwardly for engagably clamping an underside of the connectors 32.

As illustrated in FIG. 6, the bracket 134 also includes front flanges 162 extending inwardly from the side walls 158 and a central finger 164 extending downwardly from a front edge of the upper lateral wall 156. The finger 164 extends between the mounting portions 50 of the adjacent connectors 32. The finger 164 has a length only partially the height of the connectors 32 and does not extend to the bottom of the connectors.

For securing the multiple connectors 32 within the bracket 34 at a rear of the assembly, a rear of the bracket 134 includes a pair of rear walls 170. Each of the rear walls 170 extends inwardly from a rear edge 167 of a respective one of the side walls 158. The rear walls 170 nearly meet at a center of the assembly 130, thereby clamping the connectors between the rear walls 170 and the finger 164 and respective front flanges 162. The rear walls 170 substantially cover the connectors 32 at a rear of the assembly 130 to provide good shielding characteristics.

Although the present invention has been described with reference to a preferred embodiment, it should be understood that various substitutions and modifications will be apparent to those skilled in the art. For example, an embodiment of the invention can provide for tabs and flanges having various configurations, and, in an embodiment, the bracket may be configured to embrace more than two connectors. Such substitutions and modifications may be made without departing from the spirit and scope of the invention. Therefore, all such substitutions and modifications are intended to be embraced within the scope of the appended claims.

What is claimed is:

1. An electrical connector assembly comprising:

a plurality of electrical connectors having a width dimension, each of said connectors having an insulative housing containing a plurality of electrical terminals each having a contact portion for mating to a respective terminal of a complementary mating connector and a tail portion for mating to a respective conductor, each of the connectors having a conductive shield at least partially enclosing said housing, each of said shields having a mating portion proximate to said contact portions of said plurality of electrical terminals, said mating portion extending forwardly of each of said electrical connectors; and a conductive bracket comprising a lateral wall having opposed sides and opposed side walls depending from said lateral wall opposed sides, said conductive bracket embracing said plurality of electrical connectors between said opposed side walls, said opposed walls having front edges and said mating portions of said shields of said electrical connectors extend forwardly of said front edges of said opposed walls, and wherein said sidewalls are spaced apart from each other by generally said width dimension of said plurality of electrical connectors embraced by said conductive bracket.

2. The electrical connector assembly of claim 1 wherein said bracket includes inward flanges extending from said front edges of said opposed side walls each for clamping a respective one of said plurality of electrical connectors.

3. The electrical connector assembly of claim 2 wherein said shield of each of said plurality of electrical connectors has a front face outside of said mating portion of said shield and said inward flanges engage said front face of said respective one of said plurality of electrical connectors.

4. The electrical connector assembly of claim 3 wherein a finger extending from a front edge of said lateral wall clamps front faces of adjacent ones of said plurality of electrical connectors.

5. The electrical connector assembly of claim 4 wherein the finger extends centrally downwardly between the mating portions of adjacent connectors.

6. The electrical connector assembly of claim 3 wherein said bracket includes a rear wall for clamping a corresponding one of said plurality of electrical connectors.

7. The electrical connector assembly of claim 6 wherein said rear wall depends from a rear edge of said respective one of said opposed side walls and engages said corresponding one of said plurality of electrical connectors.

8. The electrical connector assembly of claim 1 wherein a lateral edge of said respective one of said side walls includes a tab for clamping said respective one of said plurality of electrical connectors.

9. The electrical connector assembly of claim 1 wherein the shield of each of one said plurality of electrical connectors includes a foot for engaging a board on which said electrical connector assembly is mounted.

10. An electrical connector assembly comprising:

a plurality of electrical connectors having a width dimension, each of said connectors having an insulative housing containing an electrical terminal having a contact portion for mating to a respective terminal of a complementary mating connector and a tail portion for mating to a respective conductor and a conductive shield on said housing, said shield having a mating portion proximate to said contact portion of said electrical terminal and a front face outside of said mating portion, said mating portion extending forwardly of each of said plurality of electrical connectors; and a conductive bracket comprising a lateral wall having opposed sides and opposed side walls depending from said lateral wall opposed sides, said conductive bracket embracing said plurality of electrical connectors between said opposed side walls, said opposed walls each having front edges with inward flanges extending from a respective one of said front edges and engaging said front face of a corresponding one of said plurality of electrical connectors, a rear wall depending from a rear edge of one of said opposed walls and said lateral wall, said rear wall engaging a respective one of said electrical connectors and said mating portions of said shields of said electrical connectors extend forwardly of said front edges of said opposed walls, and wherein said sidewalls are spaced apart from each other by generally said width dimension of said plurality of electrical connectors embraced by said conductive bracket.

11. The electrical connector assembly of claim 10 wherein a finger extending from a front edge of said lateral wall clamps front faces of adjacent ones of said plurality of electrical connectors.

12. The electrical connector assembly of claim 10 wherein a lateral edge of a respective one of said side walls includes a tab for clamping said respective one of said plurality of electrical connectors.

13. The electrical connector assembly of claim 10 wherein the shield of each of one of said plurality of electrical connectors includes a foot for engaging a board on which said electrical connector assembly is mounted.

14. An electrical connector assembly comprising:

a plurality of electrical connectors having a width dimension, each of said connectors having an insulative housing containing a plurality of electrical terminals each having a contact portion for mating to a respective terminal of a complementary mating connector and a tail portion for mating to a respective conductor, each of the connectors having a conductive shield at least partially enclosing said housing, each of said shields having a mating portion proximate to said contact portions of said plurality of electrical terminals, said mating portion extending forwardly of each of said electrical connectors; and a conductive bracket comprising a lateral wall and opposed side walls depending from said lateral wall, said conductive bracket embracing said plurality of electrical connectors between said opposed side walls, said opposed walls having front edges and said mating portions of said shields of said electrical connectors extend forwardly of said front edges of said opposed walls, and wherein said lateral wall has a width dimension being generally said width dimension of said plurality of electrical connectors embraced by said conductive bracket.

15. The electrical connector assembly of claim 14 wherein said bracket includes inward flanges extending from said front edges of said opposed side walls each for clamping a respective one of said plurality of electrical connectors.

16. The electrical connector assembly of claim 15 wherein said shield of each of said plurality of electrical connectors has a front face outside of said mating portion of said shield and said inward flanges engage said front face of said respective one of said plurality of electrical connectors.

17. The electrical connector assembly of claim 16 wherein a finger extending from a front edge of said lateral wall clamps front faces of adjacent ones of said plurality of electrical connectors.

18. The electrical connector assembly of claim 14 wherein said bracket includes a rear wall for clamping a corresponding one of said plurality of electrical connectors.

19. The electrical connector assembly of claim 14 wherein said rear wall depends from a rear edge of said respective one of said opposed side walls and engages said corresponding one of said plurality of electrical connectors.

20. The electrical connector assembly of claim 14 wherein a lateral edge of said respective one of said side walls includes a tab for clamping said respective one of said plurality of electrical connectors.

* * * * *